United States Patent [19]

Farenholtz

[11] Patent Number: 4,951,943

[45] Date of Patent: Aug. 28, 1990

[54] EXERCISE AND TRAINING APPARATUS

[76] Inventor: Douglas W. Farenholtz, #8 - 6267 West Boulevard, Vancouver, B.C., Canada, V6M 3X4

[21] Appl. No.: 341,353

[22] Filed: Apr. 21, 1989

[51] Int. Cl.[5] ..... A63B 21/00

[52] U.S. Cl. ..... 272/143; 272/118; 272/129; 272/130; 272/136

[58] Field of Search ..... 272/117, 118, 134, 136, 272/142, 143, 129, 130

[56] References Cited

U.S. PATENT DOCUMENTS

| | | | |
|---|---|---|---|
| 88,047 | 3/1869 | Lawrence . | |
| 1,861,012 | 3/1932 | Hornbeck et al. . | |
| 3,438,627 | 4/1969 | Lanne | 272/118 |
| 3,851,874 | 12/1974 | Wilkin . | |
| 4,149,714 | 4/1979 | Lambert, Jr. | 272/118 |
| 4,154,441 | 5/1979 | Gajda | 272/118 |
| 4,373,717 | 2/1983 | Lambert, Jr. | 272/118 X |
| 4,402,504 | 9/1983 | Christian | 272/118 |
| 4,422,636 | 12/1983 | De Angeli | 272/117 |
| 4,441,706 | 4/1984 | Korzaniewski | 272/118 |
| 4,600,188 | 7/1986 | Bangerter et al. | 272/118 X |
| 4,603,855 | 8/1986 | Sebelle | 272/117 |
| 4,632,388 | 12/1986 | Schleffendorf | 272/118 |
| 4,799,671 | 1/1989 | Hoggan et al. | 272/118 |
| 4,842,270 | 6/1989 | Lange | 272/117 |

FOREIGN PATENT DOCUMENTS

| | | | |
|---|---|---|---|
| 2184953 | 7/1987 | United Kingdom | 272/118 |

*Primary Examiner*—Robert Bahr

*Attorney, Agent, or Firm*—Shlesinger & Myers

[57] ABSTRACT

A training and exercise device for applying a force against a resisting force includes an upstanding frame, a rotable arm supported by the frame and for rotation about the frame in a horizontal plane and force receiving device communicating with the arm for receiving force supplied by a user. The force receiving device is longitudinally slideable along the arm to cause force to be applied against the resisting force when the force receiving device is pushed horizontally along the arm towards the frame. A grasping device is attached to the second end of the cable. The force receiving device is attached to the cable at a point between the second pulley and the third pulley.

9 Claims, 4 Drawing Sheets

EXERCISE AND TRAINING APPARATUS

BACKGROUND OF THE INVENTION

The present invention relates generally to an exercise testing and training apparatus and, more particularly, to a training apparatus which is rotatable about a horizontal plain to permit the application of force by a user, in any direction with respect to the apparatus and which permits both pushing and pulling forces to be simultaneously applied against a resisting force.

Training or exercising equipment used to develop muscle strength and which are used to test the relative strength of individuals, are well known. Such equipment usually consists of a mechanism by which the user can apply force against a resisting force contained in the apparatus. Commonly, a user applies force against a specific gripping or force receiving mechanism, which is connected to a cable. The cable is, in turn, connected, by means of one or more pulleys, to a specific weight or other force resisting means. When force is applied on the gripping means, the weight is lifted. Alternatively, the weight may be replaced by a spring, or pneumatic cylinders which provide a resisting force when force is applied on the gripping mechanism by the user.

Most of these prior art training or exercise devices provide a relatively specific orientation of the gripping or force receiving mechanism. There is no provision for moving such gripping means in a horizontal plane to permit application of force by the user in a variety of positions about the exercise machine. See for example U.S. Pat. No. 4,632,388 issued to Schleffendorf which requires the user to orient himself opposite rigid arm 16 in order to properly use the exercising system disclosed. The Schleffendorf device does not provide for use of the device by the user while positioned in a variety of positions around the circumference of the device.

A further example of such an exercise machine is disclosed in U.S. Pat. No. 4,441,706 issued to Korzaniewski. A rigidly positioned arm 26 extends outwardly from the frame requiring the user to stand opposite this arm in order to use the device.

It is also desirable, at times, to use such exercising and training devices by applying both pushing and pulling force, either alternatively, or simultaneously, on the machine. These prior exercising devices do not permit one to apply pushing and/or pulling force against the resisting force without making substantial modifications to the device, for example, by modifying pulley and cable positions.

Consequently, there is a need for a training and exercise apparatus which provides a rotatable arm for rotation in a horizontal plane to permit the user to apply force on the machine from a variety of positions about the circumference of the machine. There is also a need for a training and exercise apparatus which can accept both pulling and pushing motion, either separately or simultaneously, to apply force against the resisting force of the machine.

SUMMARY OF THE INVENTION

The present invention provides a training and exercise apparatus which has a rotatable arm for rotation in a horizontal plain to permit application of force by the user against the resisting force of the machine in any position about the circumference of that machine. In an alternative embodiment, the present invention provides a training and exercise apparatus having a force receiving means which causes force to be applied against the resisting force upon application of either pulling or pushing force on the force receiving means, or upon application of simultaneous pulling and pushing force on the force receiving means, by the user.

According to one embodiment of the invention, there is provided a training and exercise apparatus for applying force against a resisting force. The apparatus comprises an upstanding frame and a rotatable arm supported by the frame for rotation about the frame in a horizontal plain. A force receiving means communicates with the arm and receives force applied by a user. A connecting means, for connecting the force receiving means to the resisting force, is responsive to the application of force on the force receiving means to cause force to be applied against the resisting force.

In a preferred embodiment, the rotatable arm rotates about the top of the frame in a horizontal plain.

Advantageously, the force receiving means is longitudinally slidable along the arm to cause force to be applied against the resisting force when the force receiving means is pushed along said arm toward the frame, by a user. Alternatively, one end of the connecting means may be pulled by the user to cause force to be applied against the resisting force.

Preferably, the force receiving means includes a first gripping means for gripping by a user to apply force on the force receiving means. Various connecting means may be utilized. For example, a cable, wire, rope, chain or gear may be used as the connecting means.

Alternatively, the force receiving means may include lower wheels adopted for rolling on the arm and the arm may include a longitudinal upper track adopted to receive the wheels for rolling on the track. The connecting means is pullable by a user to cause force to be applied against the resisting force.

The force resisting means may include various means for applying a resisting force, for example, free or stacked weights, a spring or pneumatic cylinder, or motor driven resistance may be provided.

In an alternative embodiment of the invention there is provided a training and exercise apparatus for applying force against a resisting force. The training and exercise apparatus comprises:

(a) an upstanding frame;
(b) a horizontal arm supported by the frame at a first end;
(c) force receiving means slidably communicating with the arm;
(d) a first pulley means connected adjacent the top of the first end of the arm;
(e) second pulley means connected adjacent the top of the second end of the arm;
(f) third pulley means connected to the bottom of the arm intermediate between the first and second pulley means.
(g) a cable connecting the force receiving means to the resisting force, attached at a first end to the resisting force, the first pulley receiving the cable from the resisting force, the second pulley receiving the cable from the first pulley and the third pulley receiving the cable from the second pulley;
(h) grasping means for grasping and pulling the cable attached to the second end of the cable;
(i) attaching means for attaching the force receiving means to the cable between the second pulley and the third pulley.

Alternately the arm is rotatable about the frame in a horizontal plane. Optionally, the arm may rotate about the top of the frame in a horizontal plane.

BRIEF DESCRIPTION OF THE DRAWINGS

An embodiment of the invention will now be described in more detail with reference to the drawings, in which.

DESCRIPTION OF THE PREFERRED EMBODIMENT(S)

Figure 1:
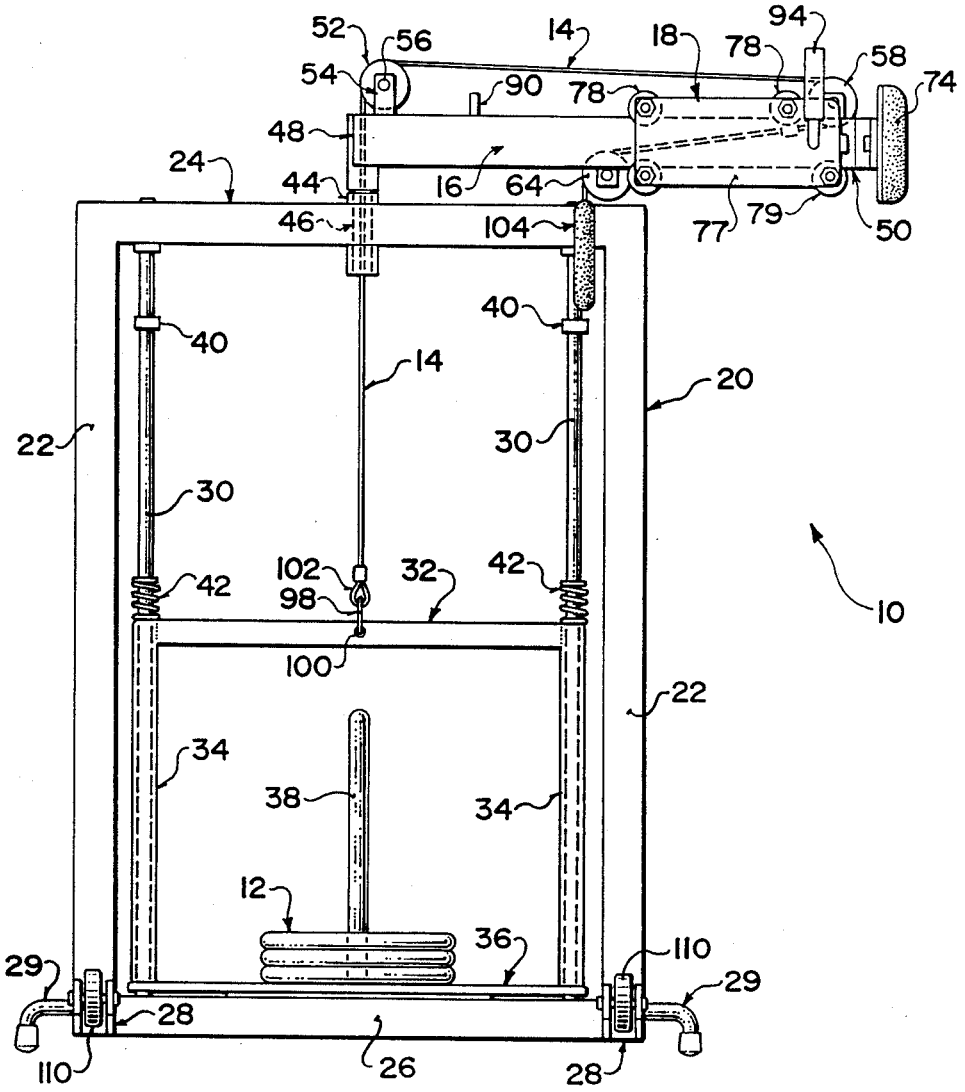
FIG. 1 is a front elevational view of a training and exercise apparatus for applying force against a resisting force, in a rest position.

Referring initially to FIG. 1, there is shown training and exercise apparatus for applying a force against a resisting force, generally designated 10, which incorporates the preferred embodiment of the present invention. Apparatus 10 basically includes a resisting force, which in this embodiment is a weight 12, a connecting means, which in this embodiment is a cable 14, an arm 16, a force receiving means, which in this embodiment is carriage 18 and frame 20. It should, however, be understood that a variety of force resisting means may be used. For example, a weight stack, spring or other resilient biasing means, a pneumatic cylinder or a motor driven resistance may be employed. As well, various connecting means may be used, such as a cable, a rope, a wire or a chain. Furthermore, as well be appreciated by one skilled in the art, various means for receiving force may be employed such as handles of varying shapes and orientation, or pads and the like.

Frame 20 is rectangular in shape with two vertical side members 22 joined at each end to longer shorter horizontal top member 24 and shorter horizontal bottom member 26. Four leg members 28 (FIG. 5) extend laterally from bottom member 26 to provide support to frame 20. An L-shaped foot member 29 extends at a 45° angle adjacent the end of each leg member 28 to provide additional support to frame 20 and apparatus 10.

A pair of vertical guide members 30 extend between top member 24 and bottom member 26. Each guide member 30 is adjacent to and parallel with respective side member 22. A rectangular weight support 32 has side members 34 for slidable vertical movement of side members 22 along guide member 30. Bottom member 36 of support 32 includes centrally disposed upwardly directed protrusion 38 extending substantially the full height of support 32. Sufficient space exists for weights 12 to be added or removed from the top of protrusion 38. Weights 12 are conventional weight lifting weights, cylindrical in shape with a central opening through which protrusion 38 may extend. Support 32 may be moved vertically between a lower position, as shown in FIG. 1, wherein bottom member 36 of support 32 rests on bottom member 26 of frame 20 and an upper position as shown in FIG. 2.

Figure 2:
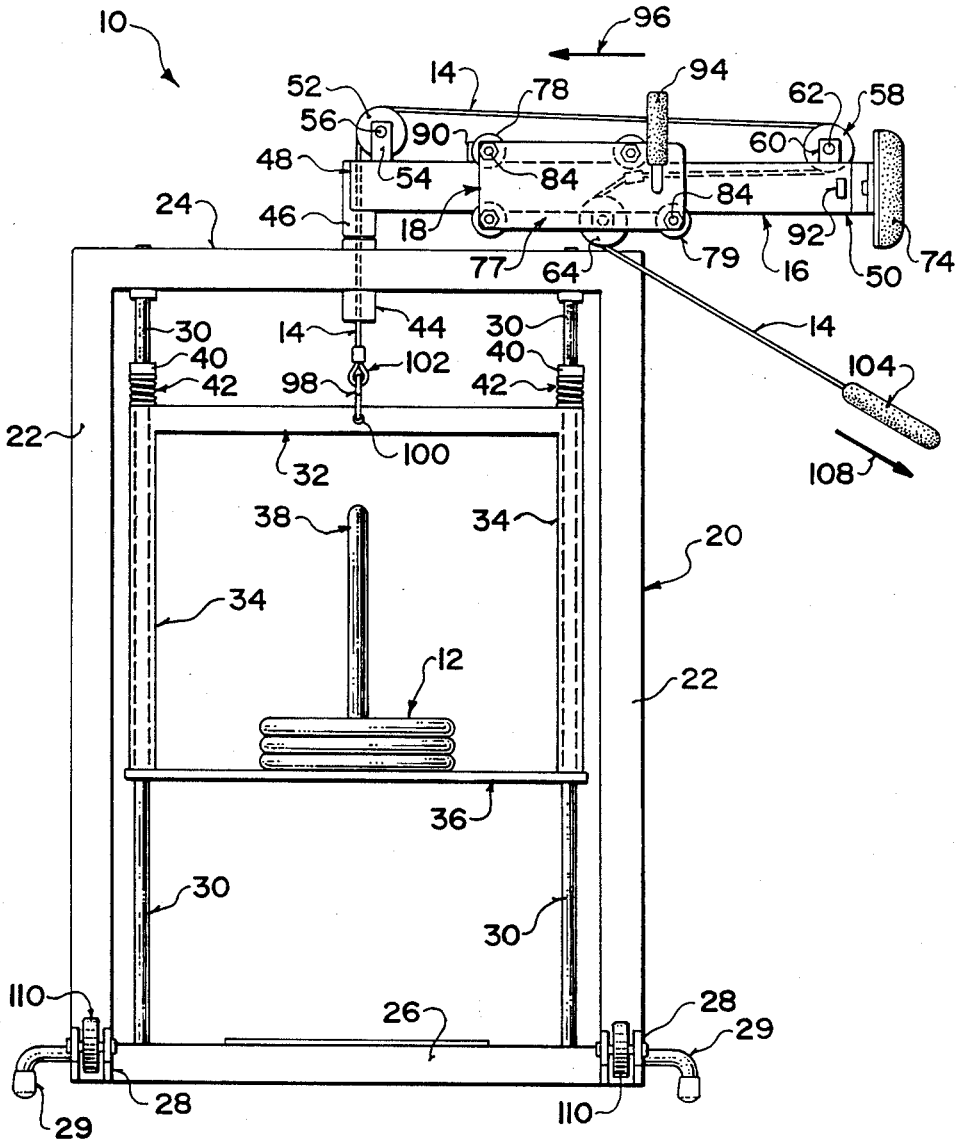
FIG. 2 is a front elevational view of the apparatus shown in a position as when force is applied against a resisting force.

Referring to FIG. 2, support 32 is shown in its upper position as when force is applied against the resisting force, in this case when force is applied to lift weights against the force of gravity. Adjustable top members 40 are located on each guide member 30 to prevent support 32 from being lifted by a user beyond a predetermined height to prevent it from striking upper frame member 24 or other portions of apparatus 10. Springs 42 are positioned on guide 30 between support 32 and stop 40 to absorb the shock of support 32 being stopped by stops 40.

Figure 6:
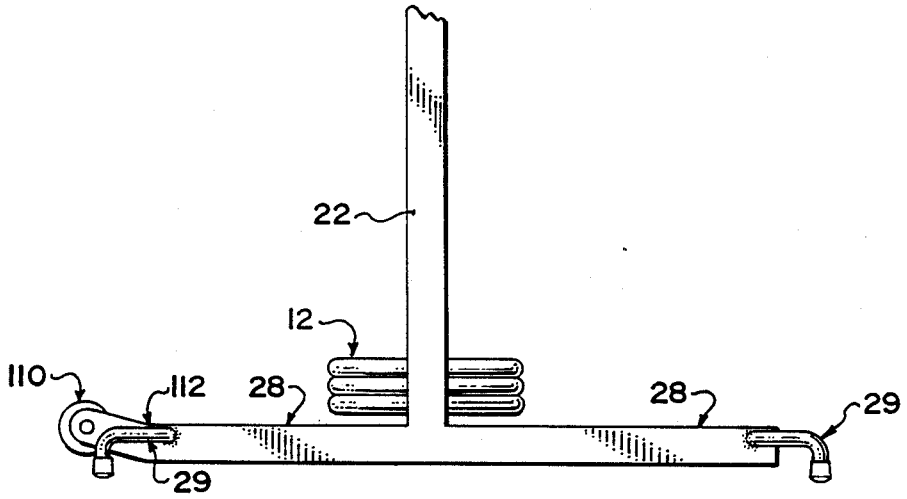
FIG. 6 is a side view of the bottom portion of the apparatus.

As seen in FIG. 6, two opposed leg members 28 are bent upwardly at bend 112. Wheels 110 are rotatably attached to the ends of leg members 28 such that when bottom portion of leg members are horizontal and resisting on the support surface wheels 110 do not contact the support surface. Apparatus 10 may be tilted towards wheels 110 so that apparatus 10 is supported by wheels 110 to facilitate movement of apparatus 10.

Arm 16 is rotatably attached to frame 20 by means of shaft 44 which extends perpendicularly through top frame member 24. Extension 46 of arm 16 is journalled longitudinally into shaft 44 for rotatable motion of arm 16 in a horizontal plane about the top of frame 20.

Arm 16 has an inner end 48 and an outer end 50, inner end 48 being adjacent extension 46. Pulley 52 is rotatably mounted on the upper portion of arm 16 adjacent inner end 48 by means of two parallel upstanding supports 54 which support pin 56 which extends through and rotatably supports pulley 52. Pulley 58 is likewise rotatably mounted to the upper portion of arm 16 adjacent outer end 50 by means of two parallel upstanding supports 60 which support pin 62 which extends through and rotatably supports pulley 58.

As seen best in FIG. 2 support 60 is shorter than support 54 and, consequently, pulley 58 is positioned lower than pulley 52. Pulley 64 is rotatably mounted to the lower portion of arm 16 approximately intermediate between pulley 52 and pulley 58 by means of two parallel lateral supports 66 which support pin 68. Pin 68 extends through and rotatably supports pulley 64.

Figure 5:
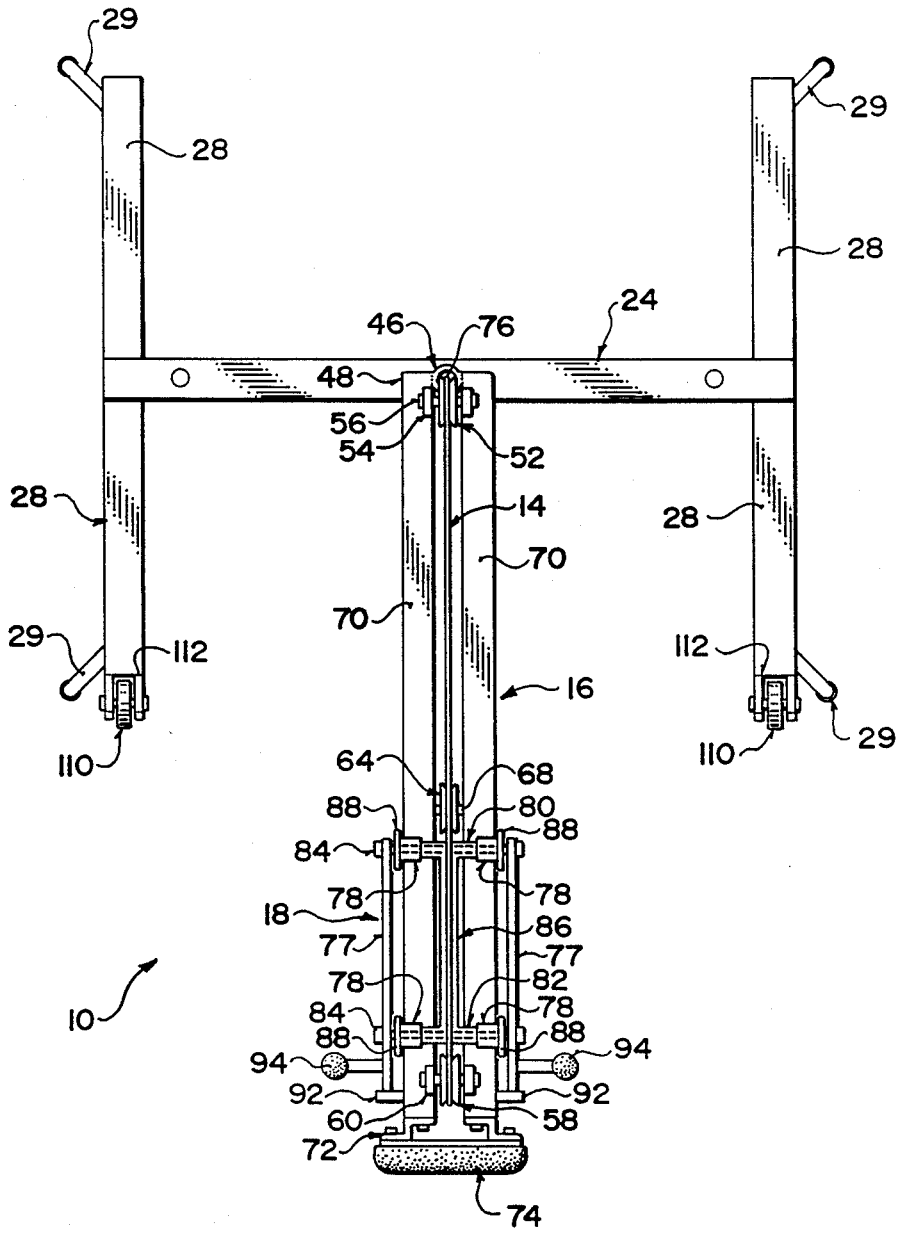
FIG. 5 is a top plan view of the apparatus.

Referring to FIG. 5, arm 16 is comprised of two parallel spaced apart rails 70 joined at each end by a lateral strut 72. Pulley 52, 58 and 64 are positioned on arm 16 in the same vertical plane midway between rails 70. As is seen more clearly in FIGS. 1 and 2, pulleys 58 and 64 are partially recessed into the space between rails 70.

In order to protect a user from injury from the outer end 50 of arm 16, padded member 74 is rigidly attached to strut 72 on outer end 50. Member 74 may be used to rotate arm 16 about axis point 76 (FIG. 5) of arm 16.

Carriage 18 is slidably mounted to arm 16 for movement between an outer rest position, as depicted in FIG. 1, and an inner, force application position, as depicted in FIG. 2. Referring initially to FIG. 1 and FIG. 5, carriage 18 includes a pair of opposed spaced rectangular sides 77 joining four upper rollers 78 which roll on the upper surfaces of rails 70 and four lower rollers 79 which roll on the lower surface of rails 70, to support carriage 18 on arm 16. Rollers 78 are rotatably attached to carriage 18 by means of inner axle 80 and outer axle 82, each of which rotatably supports an opposed pair of rollers 78. Axles 80 and 82 are secured to side members 77 by means of through bolt 84 which passes through an inner cavity in axles 80 and 82 and which is secured to each side 77. A lateral beam 86 joins axles 80 and 82 to provide added support and rigidity to axles 80 and 82.

Rollers 78 and 79 have outer circular lateral flanges 88 which act to keep rollers on rails 70. As can be seen in FIG. 5, flanges 88 on opposed rollers 78 are positioned to rotate adjacent opposite outer edges of respective rails 70.

Similarly, four bottom rollers 79 are positioned on carriage 18 below arm 16 for rolling on the lower surface of rails 70. Axles (not shown) and through bolts (not shown) rotatably attach rollers 79 to sides 77 in a manner similar to that described above with respect to axle 80 and bolt 84. As can be seen in FIG. 1, rollers 79 are positioned to sandwich arm 16 between rollers 78 and 79 to slidably retain carriage 18 onto arm 16 and to provide a minimum of vertical "play"of carriage 18 on arm 16. A set of lower rollers 79 are positioned adjacent each lower corner of sides 77. Upper rollers 78 connected to inner axle 80 are positioned adjacent the inner upper corner of sides 77. Upper rollers 78 connected to outer axle 82 are offset vertically from the outer upper corner of sides 77 to enable carriage to be rolled to the rest position shown in FIG. 1 without contacting pulley 58.

In order to prevent carriage 18 from contacting pulley 52 when carriage 18 is pushed to its inner position, stop 90 is secured between rails 70 at a suitable position to contact and prevent further inner motion of carriage 18. Stop 90 is positioned so as to contact inner axle 80 of carriage 18. In order to prevent carriage 18 from contacting pulley 58 when carriage 18 is returned to its outer, rest position, a stop 92 is positioned on each outer side of rails 70 adjacent outer end 50 at a suitable position to contact and prevent further outer motion of carriage 18. Stops 92 are positioned so as to contact each side 77 of carriage 18. In this manner carriage 18 is constrained to move between stop 90 and stops 92 along arm 16.

Carriage 18 also includes a pair of opposed upward L-shaped handle grips 94 attaChed to respective sides 77. Handle qrips 94 provide a convenient handle for a user to hold and push or hit in an inward direction, that is in the direction of the arrow shown at reference numeral 96 in FIG. 2, to move carriage 18 inwardly. Appropriate pads may be attached to grips 94 depending on the user interaction desired.

The connecting means, here cable 14, will now be discussed with reference to FIGS. 1 and 2 and with reference to FIGS. 3 and 4. One end of cable 14 is connected to support 32 by means of S-shaped hook 98. One end of hook 98 is engaged in opening 100 of support 32 which opening is positioned intermediate between side members 34 of support 32. The other end of hook 98 is engaged in opening of loop 102 connected to the said end of cable 14. Alternatively, a swivel attachment (not shown) may be provided to permit rotation of cable 14 while attached to hook 98. Cable 14 extends upwardly through vertical opening (not shown) in shaft 44 and through opening (not shown) in extension 46. Cable 14 extends through arm 16 to pulley 52 which has an outer groove about its circumference (not shown) to accept and retain cable 14 about pulley 52. Cable 14 then extends substantially horizontally to Pulley 58 which also has an outer groove about its circumference to accept and retain cable 14 about pulley 58.

Figure 3:
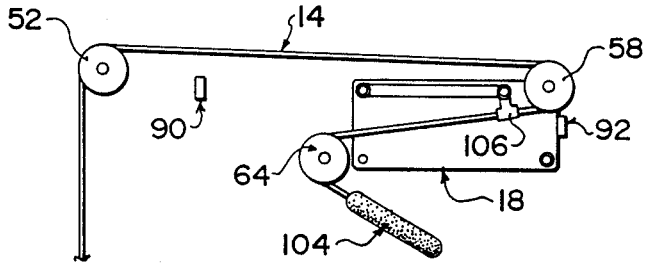
FIG. 3 is a side schematic view of the arm, with parts removed, in a rest position.
Figure 4:
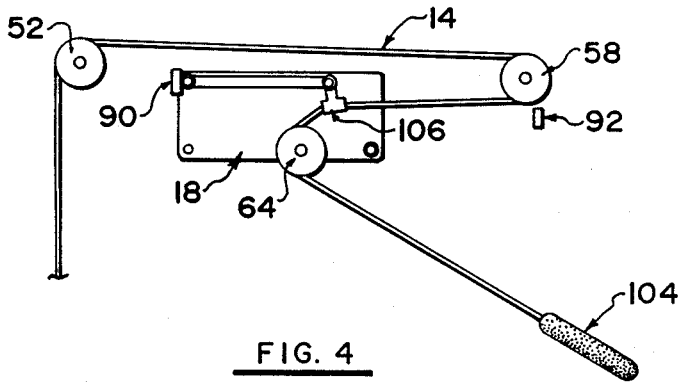
FIG. 4 is a side schematic view of the arm; with parts removed, shown in a position as when force is applied against the resisting force.

Referring now to FIGS. 3 and 4, cable 14 loops around pulley 58 in an inward direction and extends to pulley 64. Pulley 64 also has an outer groove about its circumference to accept and retain cable 14 about pulley 64. Grip rope 104 is rotatably attached to the end of cable 14 adjacent pulley 64. Preferably, the length of cable 14 selected will be just enough to provide for the attachment of grip rope 104 to cable 14 just beyond the periphery of pulley 64 when support 32 is in its lowered or rest position as shown in FIG. 1.

Cable 14 is rigidly attached to carriage 18 by means of anchor sleeve 106 which is attached to the inside of carriage 18. Set screws (not shown) through sleeve 106 are used to rigidly attach cable 14 to anchor sleeve 106. Movement of carriage 18 towards pulley 52 will thereby cause cable 14 to be pulled with carriage 18 thereby lifting support 32. As well, pulling action on grip rope 104 (as for example in the direction of the arrow shown at reference numeral 108 of FIG. 2) will cause carriage 18 to move towards pulley 52 thereby causing cable 14 to lift support 32. In this manner, pushing action on handle grips 94 or pulling action on grip rope 104 will cause lifting force to be applied to support 32. Furthermore simultaneous pushing and pulling force may be applied to lift support 32.

Operation:

The operation of apparatus 10 will now be described with reference to FIGS. 1 and 2. Initially the user rotates arm 16 in a horizontal plane about axis 76 (FIG. 5) to orient arm 16 in an appropriate position about frame 20 while performing the desired exercise or training movements. Optionally a stop mechanism may be employed to temporarilY fix arm 16 in the selected position. The user may then apply pulling force on grip rope 104, or pushing force on handle grips 94 to cause lifting forces to be applied through cable 14 onto support 32. Once sufficient force is applied to overcome the force of gravity on support 32 and weights 12, support 32 will be lifted by cable 14. Alternatively the user may hold grip rope 104 in one hand and hold handle grip 94 in the other hand to apply simultaneous pushing and pulling force to lift support 32. The application of the pushing and pulling force may occur while the user rotates arm 16 about axis 76.

The user may adjust the amount of force required to lift support 32 by adding or subtracting weights from protrusion 38.

Apparatus 10 may be rolled on wheels 110 by tilting frame 20 in the direction of wheels 110 to pivot apparatus 10 about bend 112 to rest apparatus 10 on wheels 110. Pushing or pulling action on frame 20 will then cause apparatus 10 to roll on wheels 110.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A training and exercise apparatus for applying force against a resisting force, comprising:

(a) an upstanding frame;

(b) a rotatable arm supported by said frame at a first end for rotation about the top said frame in a horizontal plane;

(c) force receiving means, communicating with said arm, for receiving force applied by a user;

(d) a resisting force;

(e) cable means for connecting said force receiving means to said resisting force, connected to said force receiving means adjacent a first end and to said resisting force at a second end, responsive to the application of pulling force on said force receiving means to cause force to be applied against said resisting force;

(f) said force receiving means including lower wheels and said arm including a longitudinal upper track adapted to receive said wheels for rolling on said track;

(g) a vertical opening, adjacent said first end, extending through said frame and said arm to receive said cable means therethrough;

(h) a first pulley on said arm for receiving said cable through said opening from said force resisting means;

(i) a second pulley on said arm adjacent to second end of said arm for receiving said cable from said first pulley;

(j) a third pulley on the bottom of said arm substantially intermediate between said first and second ends of said arm for receiving said cable from said second pulley;

(k) connecting means for connecting said force receiving means to said cable between said second and third pulleys.

2. An apparatus as defined in claim 1 wherein said force resisting means is a weight hanging from said second end of said cable below said opening.

3. An apparatus as defined in claim 1 wherein a second griping means is connected to said cable for gripping by a user to cause said first end of said cable to be pulled.

4. An apparatus as defined in claim 1 wherein said force receiving means is longitudinally slideable along said arm to cause force to be applied against said resisting force when said force receiving means is pushed horizontally along said arm towards said frame.

5. An apparatus as described in claim 1 wherein said resisting force is either a weight, a weight stack, a spring, pneumatic cylinders or a magnetic resistance.

6. A training and exercise apparatus for applying force against a resisting force, comprising:

(a) a resisting force;

(b) an upstanding frame;

(c) a horizontal arm supported by said frame at a first end;

(d) forcing receiving means slideably communicating with said arm;

(e) first pulley means connected adjacent the top of the first end of said arm;

(f) second pulley means connected adjacent the top of the second end of said arm;

(g) third pulley means connected to the bottom of said arm intermediate between said first and second pulley means;

(h) a cable connecting said force receiving means to said resisting force, attached at a first end to said resisting force, said first pulley receiving said cable from said resisting force, said second pulley receiving said cable from said first pulley and said third pulley receiving said cable from said second pulley;

(i) grasping means, for grasping and pulling said cable, attached to said second end of said cable;

(j) attaching means, for attaching said force receiving means to said cable, between said second pulley and said third pulley.

7. An apparatus as described in claim 6 wherein said arm is rotable about said frame in a horizontal plane.

8. An apparatus as described in claim 7 wherein said arm rotates about the top of said frame in a horizontal plane.

9. An apparatus as described in claim 6 wherein said resisting force is either a weight, a weight stack, a spring, pneumatic cylinder or a magnetic resistance.

* * * * *